US005505178A

United States Patent [19]

Cooke

[11] Patent Number: 5,505,178

[45] Date of Patent: Apr. 9, 1996

[54] FUEL INJECTION PUMPING APPARATUS

[75] Inventor: Michael P. Cooke, Kent, England

[73] Assignee: Lucas Industries, England

[21] Appl. No.: 399,296

[22] Filed: Mar. 3, 1995

[30] Foreign Application Priority Data

Mar. 5, 1994 [GB] United Kingdom ..... 9404253

[51] Int. Cl.[6] ..... F02M 37/04

[52] U.S. Cl. ..... 123/450; 123/494

[58] Field of Search ..... 123/494, 450, 123/449, 500, 501; 73/119 A; 417/462

[56] References Cited

U.S. PATENT DOCUMENTS

| | | | |
|---|---|---|---|
| 4,388,907 | 6/1983 | Sugo | 123/494 |
| 4,495,915 | 1/1985 | Shinoda | 123/500 |
| 4,574,756 | 3/1986 | Ito | 123/500 |
| 4,643,155 | 2/1987 | Oneill | 123/500 |
| 4,653,454 | 3/1987 | Konishi | 123/494 |
| 4,656,990 | 4/1987 | Miyaki | 123/500 |
| 5,063,903 | 11/1991 | Wahl | 123/494 |
| 5,103,792 | 4/1992 | Winkler | 123/494 |
| 5,357,930 | 10/1994 | Fehlman | 123/449 |

*Primary Examiner*—Carl S. Miller
*Attorney, Agent, or Firm*—Andrus, Sceales, Starke & Sawall

[57] ABSTRACT

A fuel injection pump apparatus has a cam ring angularly adjustable within a housing in which is also mounted a rotary drive shaft having an enlarged piston provided with teeth about its periphery. A transducer is provided to sense the passage of the teeth and this includes a part fixed on the housing and a second part mounted on the cam ring. The first part defines a pair of pole pieces which have opposite magnetic polarity and the second part carries a pair of magnetizable plates which remain in close proximity to the pole pieces, the plates defining projections which are in close proximity to the teeth. A sensing coil is provided in the first component and provides a signal as the reluctance between the projections varies as the teeth move past the projections.

8 Claims, 2 Drawing Sheets

FUEL INJECTION PUMPING APPARATUS

This invention relates to a fuel injection pumping apparatus for supplying fuel to an internal combustion engine and comprising a housing, a cam actuated pumping plunger slidable in a bore, a plunger actuating mechanism having a first part which is mounted for rotation in the housing and which in use is driven by the engine to actuate the pumping plunger and a second part mounted in the housing and which is angularly adjustable therein about the axis of rotation of the first part to enable the timing of inward movement of the plunger to be varied and transducer means responsive to indicia on said first part, said transducer means providing an electrical output signal for use in a control system of the apparatus.

WO93/03270 describes an apparatus of the aforesaid type in which a sensing coil from which the output signal is obtained is mounted on the housing of the apparatus so that the electrical connections thereto do not have to accommodate any movement of the parts of the drive mechanism. A disadvantage of the arrangement shown in the published specification is that the sensing coil surrounds a part of the plunger actuating mechanism or a component which is carried by a part of the mechanism. As a result the assembly and disassembly of the apparatus involves engaging or disengaging the sensing coil about said component or part leading to a risk of damage to the sensing coil.

The object of the present invention is to provide an apparatus of the kind specified in an improved form.

According to the invention said transducer means comprises a first component fixedly mounted on said second part, a second component fixedly mounted on the housing, said components being mechanically separated from each other, a pair of energy conducting elements carried by said first component and which are coupled in an intermittent manner through air gaps respectively as the indicia move past the first component, a further pair of energy conducting elements carried by said second component and which remain in energy conducting relationship across air gaps with said first mentioned pair of elements respectively throughout the angular movement of said first component, first means for delivering energy into the energy conducting path formed by said elements and second means responsive to the fluctuation of energy in said path as the indicia move past the first component.

An example of an apparatus in accordance with the invention will now be described with reference to the accompanying drawings in which.

Figure 1:
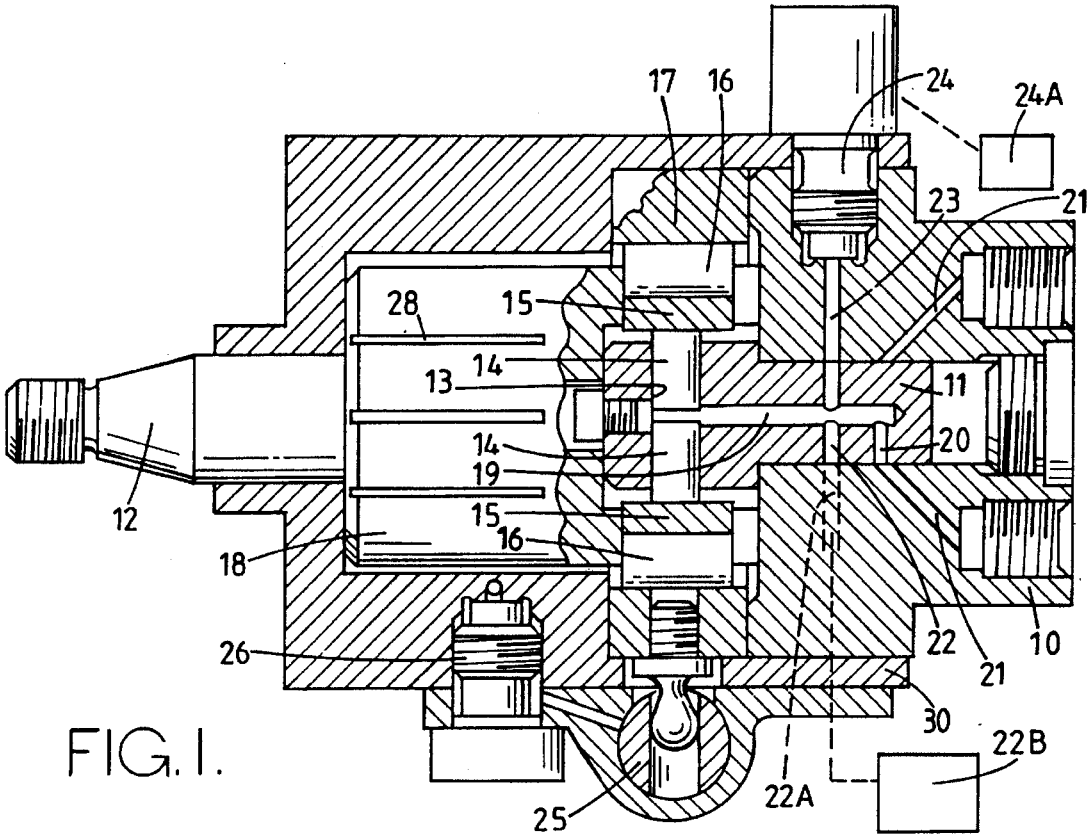
FIG. 1 is a sectional side elevation of a fuel pumping apparatus.

Referring to FIG. 1 of the drawings the apparatus comprises a multipart housing 10 in which is journaled a rotary cylindrical distributor member 11. The distributor member is coupled to a drive shaft 12 extending from the housing and arranged in use to be driven in timed relationship by the associated engine.

Formed in the distributor member is a transverse bore 13 in which is mounted a pair of pumping plungers 14 which at their outer ends, engage shoes 15 respectively which in turn carry rollers 16. The rollers and shoes constitute cam followers for engagement with the internal peripheral surface of a cam ring 17 which is mounted for angular adjustment within the housing. The cam ring on its internal surface is provided with a plurality of equi-angularly spaced cam lobes and the cam followers are mounted in radially disposed slots which are formed in an enlarged portion 18 of the drive shaft which surrounds the distributor member. The cam lobes together with the cam followers and the drive shaft constitute the plunger actuating mechanism.

Communicating with the bore 13 is a longitudinal passage 19 which in turn communicates with an outwardly extending delivery passage 20 which is arranged to register in turn as the distributor member rotates, with a plurality of outlet ports 21 which in use are connected to the injection nozzles of the associated engine. Also communicating with the passage 19 is a plurality of radially disposed inlet passages 22 and these can register in turn with an inlet port 22A which is formed in the housing 10 and which is in communication with the outlet of a source 22B of fuel under pressure. The pressure of fuel delivered by the source is arranged to vary in accordance with the speed at which the apparatus is driven and conveniently the source 22B is constituted by a vane type pump having a rotor which is driven from the distributor member.

The inlet ports 22 can also communicate in turn with a spill port 23 such communication being established during the time when the delivery passage 20 is in communication with an outlet port 21. The flow of fuel through the spill port 23 is controlled by an electrically operated spill control valve 24 the operation of which is controlled by an electrical control system 24A.

In operation, when the rollers 16 of the cam followers engage the leading flanks of the cam lobes, fuel will be displaced from the bore 13 and will flow through the delivery passage 20 to an outlet port 21. Fuel will only be displaced to the outlet port if the spill control valve 24 is closed and hence this valve is used to determine the quantity of fuel which is supplied by the apparatus to the associated engine at each injection stroke of the pumping plungers. As the distributor member rotates, the delivery passage 20 moves out of register with the outlet port and an inlet passage moves into register with the inlet port 22A. Fuel is therefore supplied to the bore 13 to effect full outward movement of the plungers 14 and the associated cam followers, as permitted by the cam lobes or by stop plates not shown. During continued rotation of the distributor member the inlet passage 22 is moved out of register with the inlet port 22A and the delivery passage 20 moves into register with the next outlet port 21 so that fuel is supplied to the outlet ports in turn during successive inward movements of the pumping plungers.

The timing of delivery of fuel is varied by moving the cam ring 17 angularly within the housing and this is effected in known manner by means of a fluid pressure operable piston 25 which is housed within a cylinder and which is spring biased in the retard direction. Fuel can be admitted to the cylinder directly from the source 22B or alternatively and as shown, an electrically operated valve 26 is provided and this is also controlled by the control system 24A.

Figure 3:
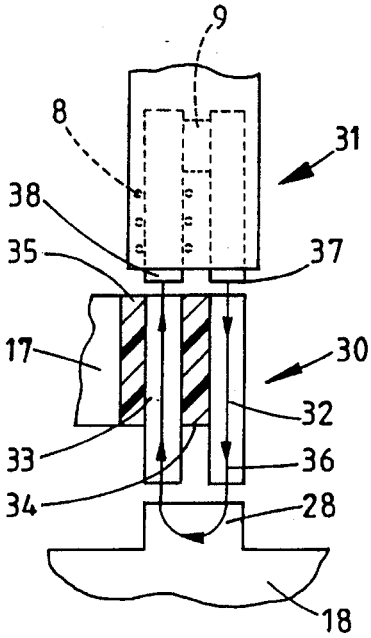
FIG. 3 is a diagrammatic view taken at right angles to FIG. 2.
Figure 2:
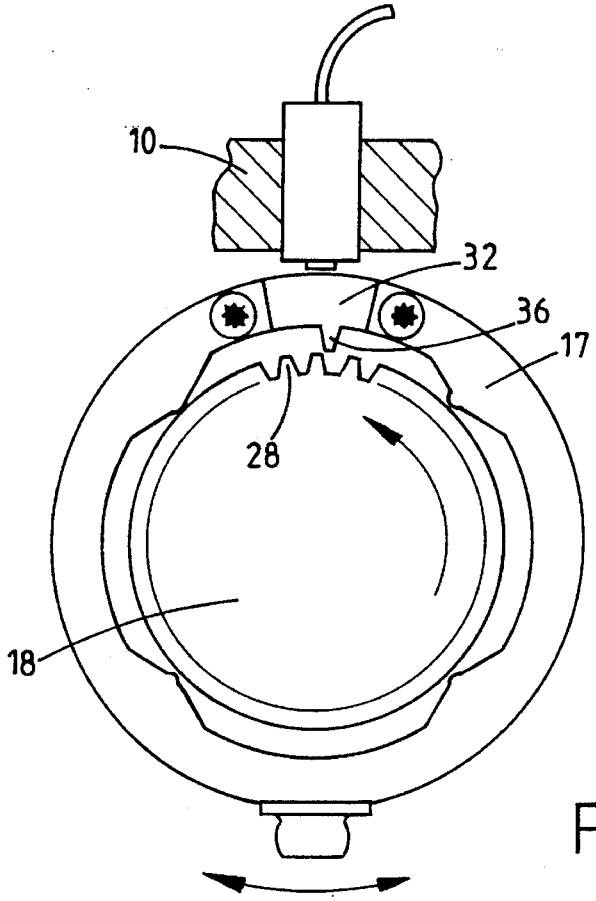
FIG. 2 is a section through the apparatus showing one form of transducer.

The control system 24A in order that it can control the operation of the spill control valve 24 needs to be supplied with signals indicative of the speed of the associated engine and also the position of the distributor member relative to the cam ring 17. The speed signal may be provided by a simple transducer located in the housing and which is responsive to the passage of indicia formed on the drive shaft. In the example the indicia are in the form of grooves or teeth 28 cut into the periphery of the drive shaft at equally spaced intervals about the drive shaft. A further transducer which is to be described, is also provided and this incorporates a part which is carried on the cam ring but it is also responsive to the passage of the teeth on the drive shaft. Turning now to FIGS. 2 and 3, there is shown in side elevation, the cam ring 17 with the inwardly extending cam lobes and mounted on the cam ring is a first component 30 of a transducer which includes a second component 31 fixed in the pump housing. The first component in the example of FIGS. 2 and 3 comprises a pair of energy conducting elements in the form of arcuate plates 32, 33 formed from magnetizable material and which are separated from each other by a spacer 34 of non-magnetic material. The plates and spacer are secured to the cam ring with a further non-magnetic spacer 35 being provided intermediate the plate 33 and the cam ring 17. Non-magnetic screws are utilised. Each of the plates is provided with an inwardly extending tooth like projection 36 the tips of the projections lie in close proximity to the crests of the teeth 28 on the drive shaft.

The second component 31 of the transducer includes further pair of energy conductive components in the form of a pair of pole pieces 37, 38 which lie in close proximity to the outer surfaces of the plates 32, 33 respectively and the second component of the transducer includes a magnet 9 which polarises the pole pieces, and also a sensing coil 8 which is wound about one of the pole pieces. As the drive shaft rotates, the reluctance of the magnetic circuit varies as the teeth 28 move past the projections 36 and a signal is produced in the sensing coil for use in the control system. The circumferential length of the pole pieces 37, 38 is less than that of the plates 32, 33 so that there will be substantially no variation in the reluctance of the magnetic circuit due to angular movement of the cam ring 17 within the housing.

Figure 4:
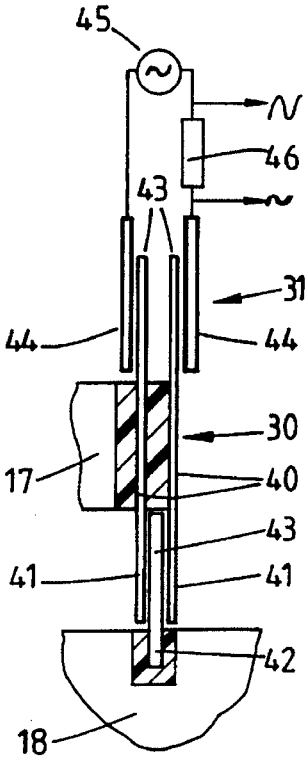
FIGS. 4 and 5 are diagrammatic views similar to FIG. 3 showing alternative forms of transducer.

In the arrangement shown in FIG. 4 the first component 30 is formed by a pair of metal plates 40 which like the plates 32, 33 in the example of FIGS. 2 and 3 are secured to the cam ring 17 but in this case the spacers are formed from electrically insulating material. The portions 41 of the plates which extend towards the drive shaft are narrow in circumferential width and are positioned in spaced relationship on opposite sides of a series of spokes 43 forming the indicia and which extend outwardly from a ring 42 formed from electrically conductive material and which is mounted in insulating relationship on the drive shaft 18.

The portions 43 of the plates 40 which extend outwardly of the cam ring are located in spaced relationship relative to a further pair of electrically conductive plates 44 which form part of the second component 31 of the transducer. The plates 44 are located on the outer sides of the portions 43 and in use are connected to an AC source 45, one of the plates having a resistor 46 in series therewith. The source 45 and the resistor may be incorporated into the control system 24A which may be secured to the housing. In use, as the shaft rotates, the impedance of the circuit constituted by the resistor and the various air gaps will vary as the spokes 43 move between the portions 41 of the plates and the voltage developed across the resistor will vary.

Figure 5:
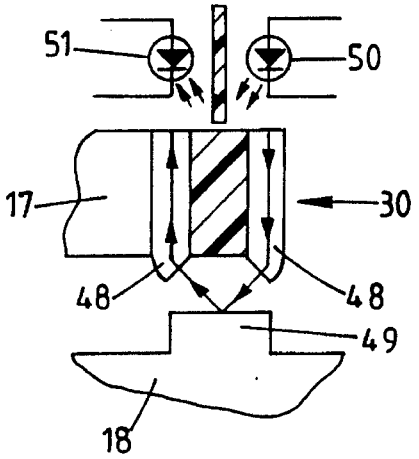

In the arrangement shown in FIG. 5, the first component of the transducer includes a pair of light guides 48 which are mounted on the cam ring and which have exit and entry windows respectively facing a common point on the crests of the teeth 49 on the drive shaft 18. The second component includes a light emitting diode 50 the light from which passes into one of the light guides 48, and a light responsive diode 51 which receives the light reflected from the crests of the teeth 49 by way of the other light guide. As the shaft rotates a fluctuating signal will be obtained at the output terminals of the diode 51. Instead of the teeth 49 the surface of the drive shaft can be provided with strips of reflective medium.

The transducer described with reference to FIG. 3 includes a sensing coil and the projections 36 are in angular alignment. Instead of the sensing coil a pair of magneto-resistive elements may be associated with the pole pieces 37, 38 in which case the projections 36 are displaced angularly relative to each other by about the arcuate length of the crest of the teeth 28.

I claim:

1. A fuel injection pumping apparatus for supplying fuel to an internal combustion engine comprising a housing a cam actuated pumping plunger slidable in a bore, a plunger actuating mechanism having a first part which is mounted for rotation in the housing and which in use is driven by the engine to actuate the pumping plunger and a second part mounted in the housing and which is angularly adjustable about the axis of rotation of the first part to enable the timing of inward movement of the plunger to be varied, transducer means responsive to indicia on said first part, said transducer means providing an electrical output signal for use in a control system of the apparatus and including a first component fixedly mounted on said second part, a second component fixedly mounted on the housing, said components being mechanically separated from each other, a pair of energy conducting elements carried by said first component and which are coupled in an intermittent manner through air gaps respectively as the indicia move past the first component, a further pair of energy conducting elements carried by said second component and which remain in energy conducting relationship across air gaps with said first mentioned pair of elements respectively throughout the angular movement of said first component, first means for delivering energy into the energy conducting paths formed by said elements and second means responsive to fluctuation of energy in said path as the indicia move past the first component.

2. An apparatus according to claim 1, in which said first mentioned pair of energy conducting elements comprises a pair of spaced arcuate plates formed from magnetizable material, a non magnetic spacer which separates said plates, said plates defining projections respectively which are positioned so that as indicia in the form of teeth move past the projections, the reluctance of the magnetic circuit formed by the plates and the further energy conducting elements will vary.

3. An apparatus according to claim 2, in which said first mentioned conducting elements comprise a pair of pole pieces, the apparatus including a magnet for polarizing said pole pieces and sensing means for sensing the variation of magnetic flux in the pole pieces as the teeth move past the projections.

4. An apparatus according to claim 3, in which the sensing means comprises a coil located about one of said pole pieces.

5. An apparatus according to claim 3, in which the sensing means comprises a pair of magnet-resistive elements associated with the pole pieces respectively.

6. An apparatus according to claim 1, in which said first mentioned pair of energy conducting elements comprise a pair of metallic plates which are mounted in spaced relationship to each other, the plate defining portions extending towards said first part, said first part carrying metallic spokes which form said indicia, said further pair of energy conducting elements comprising a further pair of metallic plates positioned adjacent to but electrically spaced relative to the first mentioned plates, on AC supply connected to the further plates and means for providing a voltage signal which varies as the impedance of the electrical circuit formed by the plates and the spokes varies.

7. An apparatus according to claim 1, in which said first mentioned pair of energy conductive elements comprise a pair of light guides having exit and entry windows respectively facing a common point on the crests of teeth on the first part, said further pair of energy conducting elements being defined by parts associated with a light source and a light sensitive device.

8. An apparatus according to claim 7, in which said light source is a light emitting diode and the light sensitive device is a light responsive diode.

* * * * *